US005115757A

United States Patent [19]

Abe

[11] Patent Number: 5,115,757

[45] Date of Patent: May 26, 1992

[54] CLIP-CARRYING BOOKMARKER

[76] Inventor: Mitsuhiko Abe, No. 278-1, Zennoji, Sakado-shi, Saitamaken, Japan

[21] Appl. No.: 665,065

[22] Filed: Mar. 6, 1991

[51] Int. Cl.[5] ..... B42D 9/00

[52] U.S. Cl. ..... 116/237; 116/239; 242/107.7

[58] Field of Search ..... 40/116, 514, 517; 116/234, 235, 236, 237, 238, 239; 242/107.6, 107.7; 281/42

[56] References Cited

U.S. PATENT DOCUMENTS

| | | | |
|---|---|---|---|
| 2,539,687 | 1/1951 | Barsotti | 116/238 |
| 3,061,962 | 11/1962 | Fleisig | 40/517 |
| 3,245,635 | 4/1966 | Signor | 242/107 |
| 4,982,685 | 1/1991 | Abe | 116/237 |

FOREIGN PATENT DOCUMENTS

| | | | |
|---|---|---|---|
| 0301973 | 12/1928 | United Kingdom | 40/514 |

*Primary Examiner*—William A. Cuchlinski, Jr.
*Assistant Examiner*—W. Morris Worth
*Attorney, Agent, or Firm*—Armstrong, Nikaido, Marmelstein, Kubovcik & Murray

[57] ABSTRACT

A rotating plate (36) which is rotated by raising a strap (39) upward by pulling the strap (39) is provided on the outer periphery of a strap feed and take-up drum (30) of a clip-carrying bookmaker. An operating drum (39) provided with a plurality of sawtooth-shaped projections (40) on the end surface thereof and rotated when the rotating plate (36) is rotated is provided. A ratchet (42) fixed to the support shaft (31) of the strap feed and take-up drum (30) is provided inside the operating drum (39). On the other hand, a coiled spring (48) urges the operating drum (39) so that the sawtooth-shaped projections (44) of the end surface thereof are meshed with the sawtooth-shaped projections (40) of the operating drum (39) constantly, and an operating drum (43) restricted in circumferential rotation is provided. Further, a ratchet (45) to be meshed with the ratchet (42) is provided inside the operating drum (43). Thus, the clip-carrying bookmarker of the invention can eliminate a rewind of the strap irrespective of a user's intention, removal of the clip due to an engagement of an operating shaft with other article, etc.

1 Claim, 9 Drawing Sheets

CLIP-CARRYING BOOKMARKER

BACKGROUND OF THE INVENTION

1. Field of the Invention

This invention relates to a clip-carrying bookmarker.

2. Description of the Prior Art

A conventional bookmarker consists generally of an elongated piece of paper A, and a string B fastened to the paper A, as shown in FIG. 15. This bookmarker is simply inserted between pages of a book. Therefore, while a user carries a book with such a bookmarker inserted between pages thereof, or the moment he opens such a book, the bookmarker slips off and is lost in many cases. In view of this inconvenience,, a clip-carrying bookmarker shown in FIG. 16 was proposed. This clip-carrying bookmarker consists of a book cover-holding clip C formed by bending a resilient plate of a plastic in the shape of the letter "U", and a strap E which is to be inserted between pages of a book, and which is fastened to a bent base portion C' of the clip C via a ring D.

This clip-carrying bookmarker can remove the faults of the stringed bookmarker mentioned above, in such respects that, when a user carries a book with the clip-carrying bookmarker inserted therein or opens such a book, the bookmarker does not slip off. However, since the length of the strap E is invariable, the kinds of books to which this bookmarker can be applied are necessarily limited. There are books of various sizes, for example, books of a large height and books of a small height. The strap of a conventional clip-carrying bookmarker is set to be rather long so that the bookmarker can be applied to the largest possible number of kinds of books. Therefore, when this clip-carrying bookmarker is applied to a book of a small height, the lower end portion of the strap projects largely from the lower end of the book to present an unshapely appearance. Conversely, when the clip-carrying bookmarker is applied to a book of a large height, it cannot be used conveniently due to the unsatisfactorily small length of the strap thereof.

In view of these points, the inventor of the present invention has previously developed a clip-carrying bookmarker shown in FIGS. 13 and 14, and filed it with the US Patent and Trademark Bureau. (U.S. patent application Ser. No. 468,671, U.S. Pat. No. 4,982,685).

The clip-carrying bookmarker will be simply described.

FIG. 13 is a perspective view of the prior art clip-carrying bookmarker with a strap payed out to a certain extent, and FIG. 14 is a sectional view taken at the center as seen from behind.

The operation of the prior art clip-carrying bookmarker is as will be described below.

First, a clip 1 is held on a cover of a book (not shown). A tag 2 is then held between user's fingers, and a strap 3 is drawn out to a required length in accordance with the height of the book. When the strap is being drawn out, the teeth of one ratchet 4 out of the two ratchets 4 and 4' mounted fixedly on a support shaft 5 slip on those of the other 4', so that the strap 3 can be freely drawn out. When the fingers are released from the tag 2 after the strap 3 has been drawn out to an arbitrarily predetermined length, a force by which the strap feed and take-up drum 7 rewinds the strap 3 occurs due to the operation of the rubber string 6. However, at this time, the teeth of the ratchet 4 are meshed with those of the other 4' to prevent the strap feed and take-up drum 11 from being further turned. Consequently, the rewinding movement of the strap feed and take-up drum 11 is prevented, and the strap thus drawn out is maintained as it is at the mentioned length.

In order to reduce the length of the strap 3 which has already been drawn out or in order to retract such a strap into the strap storage box 8, the operating shaft member 9 may be pressed against the resilient force of the coiled spring 10. When the operating shaft member 9 is pressed, the ratchet 4, fitted in the drum 11 disengages from the ratchet 4 on the support shaft 5, and the strap feed and take-up drum 7 becomes rotatable. The strap 3 drawn out is then taken up around this drum 7.

In addition, in FIGS. 13 and 14, a reference numeral 12 denotes a guide rod fitted firmly in the core portion of the support shaft 8, and a reference numeral 13 denotes a knob provided on the end portion of the operating shaft member 9. A reference numeral 14 denotes a flange of the drum 6, and a reference numeral 15 denotes a flange of the support shaft 5.

According to such a clip-carrying bookmarker, the length of the strap attached to the clip can be regulated suitably in accordance with the height of an object book. Therefore, unlike a conventional clip-carrying bookmark, which projects largely from a book, or which is too short to be used conveniently, the clip-carrying bookmark can perfectly solve the problems. Further, while the bookmarker is not in use, the strap can be held in a rewound state in the strap storage box.

However, when such a clip-carrying bookmark is used in practice, the following problems has arisen.

Since the end portion of the operating shaft member 5 projects from the sidewall of the strap storage box 8, is pressed inside due to a certain reason, and the drawn strap 3 might be wound in the strap storage box 8 contrary to the user's intention.

Since the end portion of the operating shaft member 9 projects from the strap storage box 8 as described above, it tends to be engaged with other element. Thus, the clip 1 is sometimes removed from the book.

SUMMARY OF THE INVENTION

An object of the present invention, which has been achieved in view of these points, is to provide a clip-carrying bookmarker capable of eliminating the above-described problems by removing the operating shaft member of the conventional clip-carrying bookmarker.

In order to achieve the above and other object according to the present invention as described above, there is provided a clip-carrying bookmarker comprising a strap storage box (16) formed integrally with one piece (17) of a clip, provided with a wide strap withdrawal port (18) at the central portion of the front side thereof, provided with a rubber catch (19) in the vicinity of one sidewall therein, provided with a bearing (20) of a support shaft (31) in the vicinity of the other sidewall thereof, provided with a bearing (21) of a support shaft (38) integral with an operating drum (39) between said strap withdrawal port (18) and said bearing (20), and provided with a guide frame (22) in which a plurality of projections (46) of said operating drum (43) are slidably engaged with the inner wall thereof between said bearing (21) and said bearing (20); a cover (24) formed integrally with the other piece (25) of said clip and covered on the back surface of said strap storage box (16); a strap feed and take-up drum opened at one end thereof and closed at the other, projecting with said support shaft (31) externally from said closed end thereof in such a manner that the end of said support shaft (31) is rotatably supported to the bearing (20) of said strap storage box (16); a rubber string (33) provided in a twisted state and set at one end on a rubber string fastening catch (32) formed at the central portion of the inner surface of said strap feed and take-up drum (30) and at the other end on a rubber string fastening catch (19) formed in the interior of said strap storage box (16); a strap (34) connected at one end thereof to said strap feed and take-up drum (30) to be entirely wound on said strap feed and take-up drum (30) and drawn at the other end thereof from a strap withdrawal port (18) of said strap storage box 16 through an axial cutout (36*a*) of a rotating plate (36); a rotating plate (36) provided to extend along the shaft of said strap feed and take-up drum (30) on the outer periphery of said strap feed and take-up drum (30) with the axial cutout (36*a*) of a predetermined width at the central portion thereof; a disc (37) provided with a through hole in which the support shaft (31) of said strap feed and take-up drum (30) is rotatably inserted at the central portion thereof for holding said rotating plate (36); a support shaft (38) provided with a through hole in which the support shaft (31) of said strap feed and take-up drum (30) is rotatably inserted at the central portion thereof for said disc (37); one operating drum (39) formed integrally with said support shaft (38), provided with a plurality of sawtooth-shaped projections (40) on one end surface thereof and formed with a through hole in which the support shaft 31 of said strap feed and take-up drum (30) is rotatably inserted at the central portion thereof; a ratchet (42) arranged inside said one operating drum (39) and fixed to the support shaft (31) of said strap feed and take-up drum (30); an operating drum (43) provided with a plurality of sawtooth-shaped projections (44) to be meshed with the sawtooth-shaped projections (40) of said one operating drum (39) at one end surface thereof, integrally provided with a ratchet (45) to be meshed with said ratchet (42) inside thereof, provided with a projection (46) to be engaged with a guide frame (22) of said strap storage box (16) on the outer periphery thereof, and provided with a through hole (47) in which the support shaft (31) of said strap feed and take-up drum (30) is rotatably inserted at the central portion thereof; and a coiled spring (48) arranged between said operating drum (43) and the inner surface of the sidewall of said strap storage box (16) for urging said operating drum (43) constantly toward the other operating drum (39) side.

Operation

The operation of the present invention will now be described.

First, the operation of the clip-carrying bookmarker when the strap is pulled out will be described.

When the end of the strap is raised upward in a state that the tag is grasped to pull the strap, the upper surface of the strap is contacted with the cutout of the rotating plate to rotate it upward. Thus, the disc for holding the rotating plate, the support shaft of the disc and the operating drum integral with the support shaft are integrally rotated.

When the operating drum is rotated, the sawtooth-shaped projections provided on the end surface of the operating drum are frictioned with the sawtooth-shaped projections of another operating drum meshed with those of the operating drum, and the other operating drum is horizontally pushed against the coiled spring. In this case, when the operating drum is horizontally moved, the drum is linearly moved without rotating.

As described above, the ratchet peripherally provided inside the one operating drum thus moving horizontally is disengaged from the ratchet provided so as not to be integral with the operating drum inside the operating drum integral with the rotating shaft and fixed to the support shaft of the strap feed and take-up drum.

As mentioned above, the strap feed and take-up drum is freely rotated. Thus, when the force for pulling the strap is loosened, the strap feed and take-up drum is rotated in a direction for rewinding the strap by the operation of the rubber string.

Then, the operation of the clip-carrying bookmarker when the strap is pulled out will be described.

The ratchet fixed to the inside of the operating drum of the side to be horizontally moved, and the ratchet of the support shaft of the strap feed and take-up drum, provided inside the operating drum integral with the rotating shaft are so operated that the teeth of the one ratchet are slid from the teeth of the other ratchet while the strap is being pulled out. Therefore, the strap can be freely pulled out. At this time, the ratchet of the inside of the operating drum of the side to be horizontally moved is horizontally pushed to be moved.

When the strap is pulled out in an arbitrary length, the tag is released. Then, the strap feed and take-up drum tends to be rotated in a direction for returning the strap by the operation of the rubber string. However, at this time, the teeth of the one ratchet are meshed with the teeth of the other ratchet to stop further rotating of the strap feed and take-up drum. In this manner, the pulled-out strap is maintained in the length as it is.

The above and other objects as well as advantageous features of the invention will become apparent from the following description of the preferred embodiment taken in conjunction with the accompanying drawings,

DESCRIPTION OF THE PREFERRED EMBODIMENTS

Figure 1:
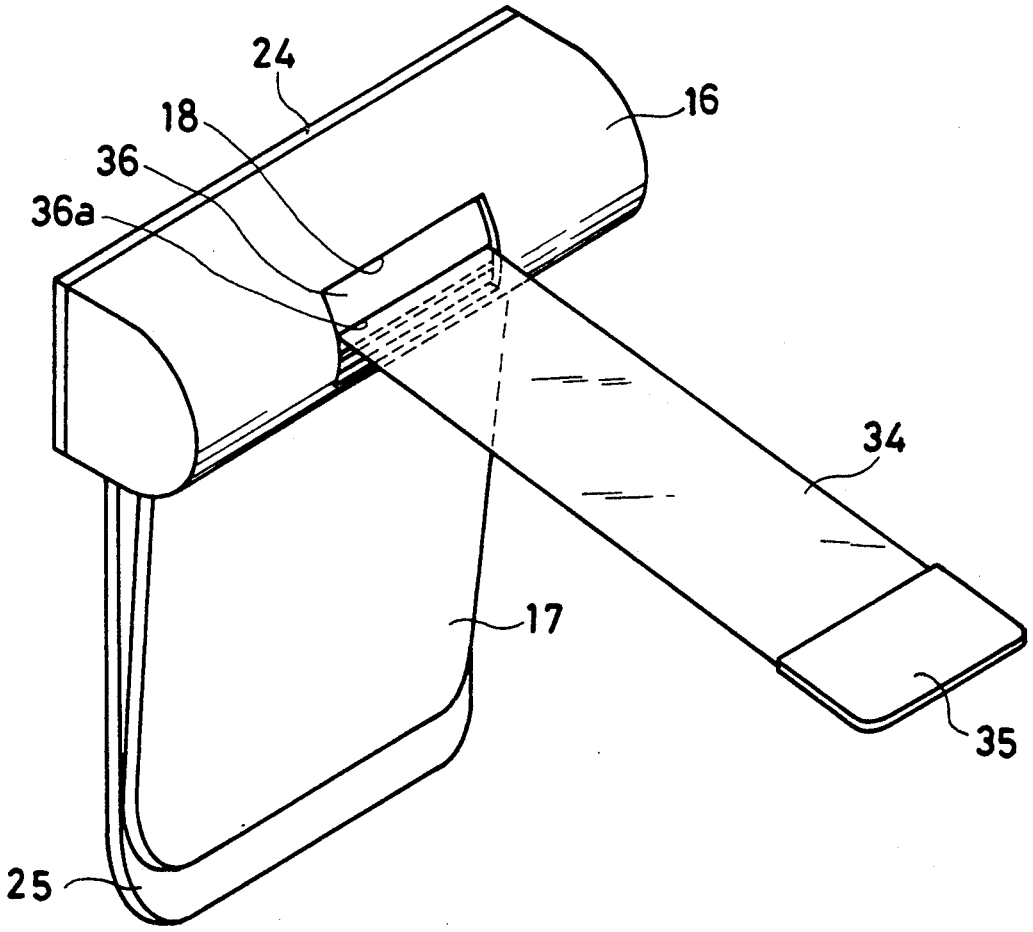
FIG. 1 is a perspective view of an embodiment of the present invention with a strap payed out to a certain extent.

The present invention will now be described on the basis of an embodiment thereof shown in the drawings.

Figure 2:
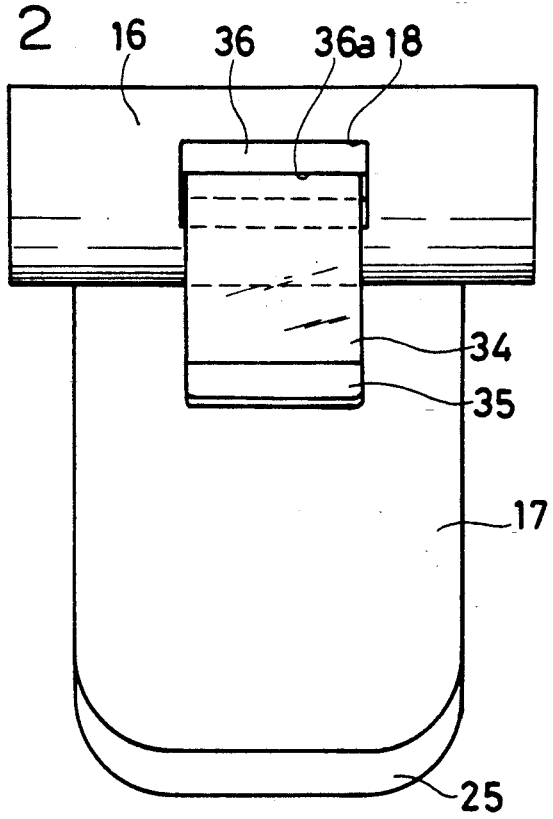
FIG. 2 is a front elevation of the entire embodiment.
Figure 3:
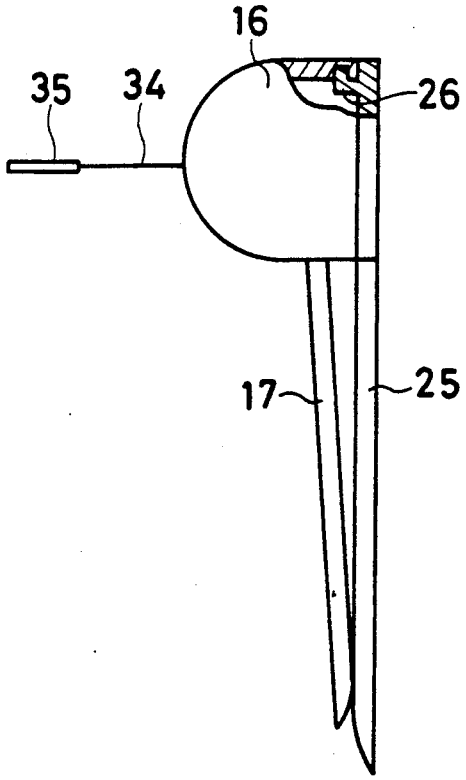
FIG. 3 is a side elevation of the embodiment in which a strap storage box is partly cut out.
Figure 4:
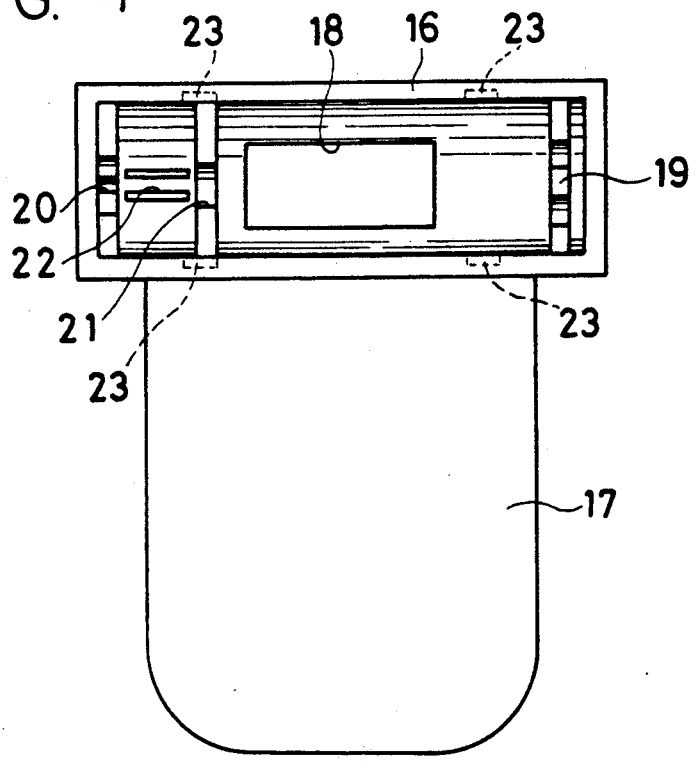
FIG. 4 is a view as seen from inside of the strap storage box integrated with one piece of a clip.
Figure 5:
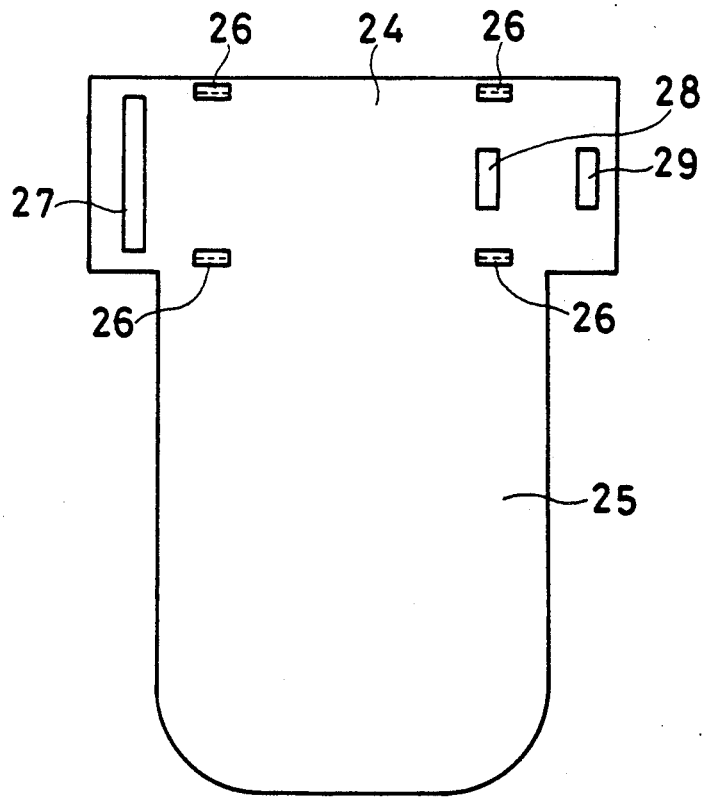
FIG. 5 is a view as seen from inside of a cover of the strap storage box integrated with one piece of the clip.
Figure 6:
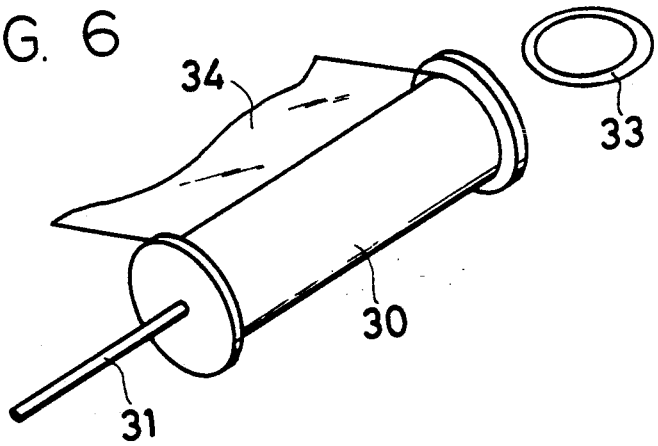
FIG. 6 is a perspective view of a strap feed and take-up drum and a rubber string.
Figure 7:
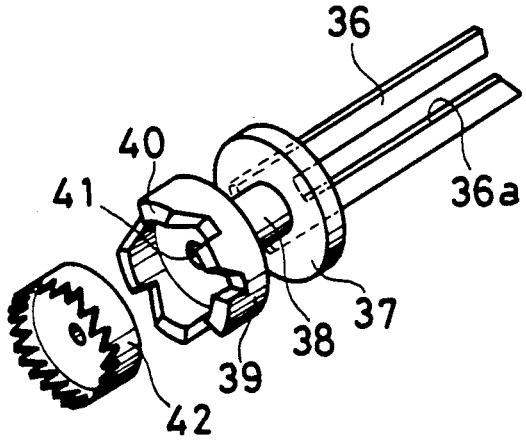
FIG. 7 is a perspective view of one operating drum and a ratchet.
Figure 8:
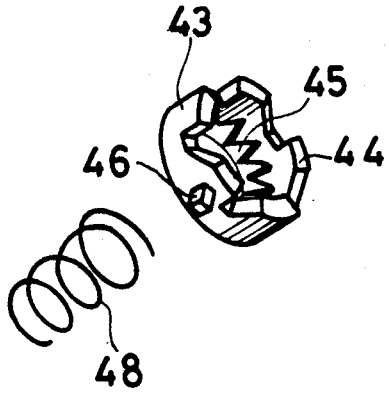
FIG. 8 is a perspective view of another operating drum and a coiled spring.
Figure 9:
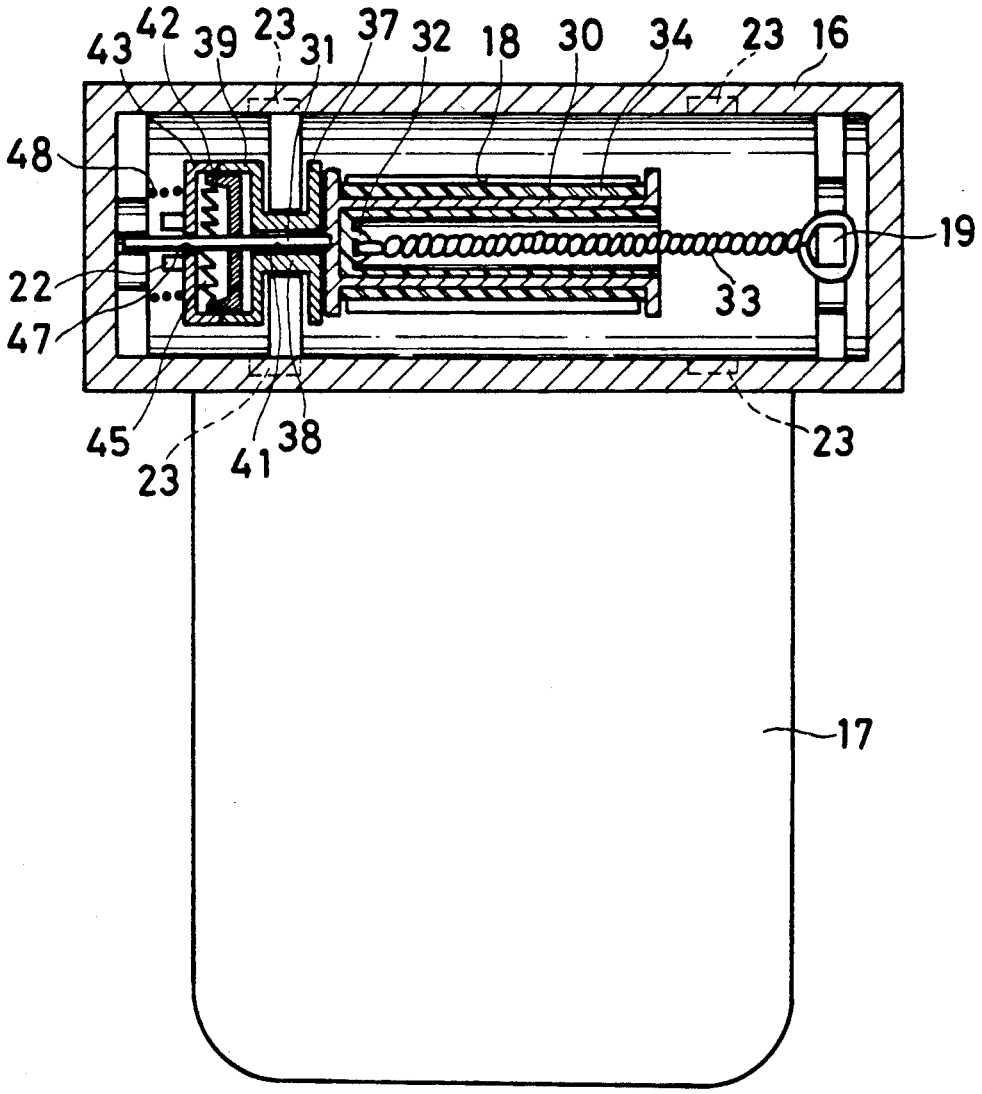
FIG. 9 is a longitudinal back view taken along the center thereof of the embodiment.
Figure 10:
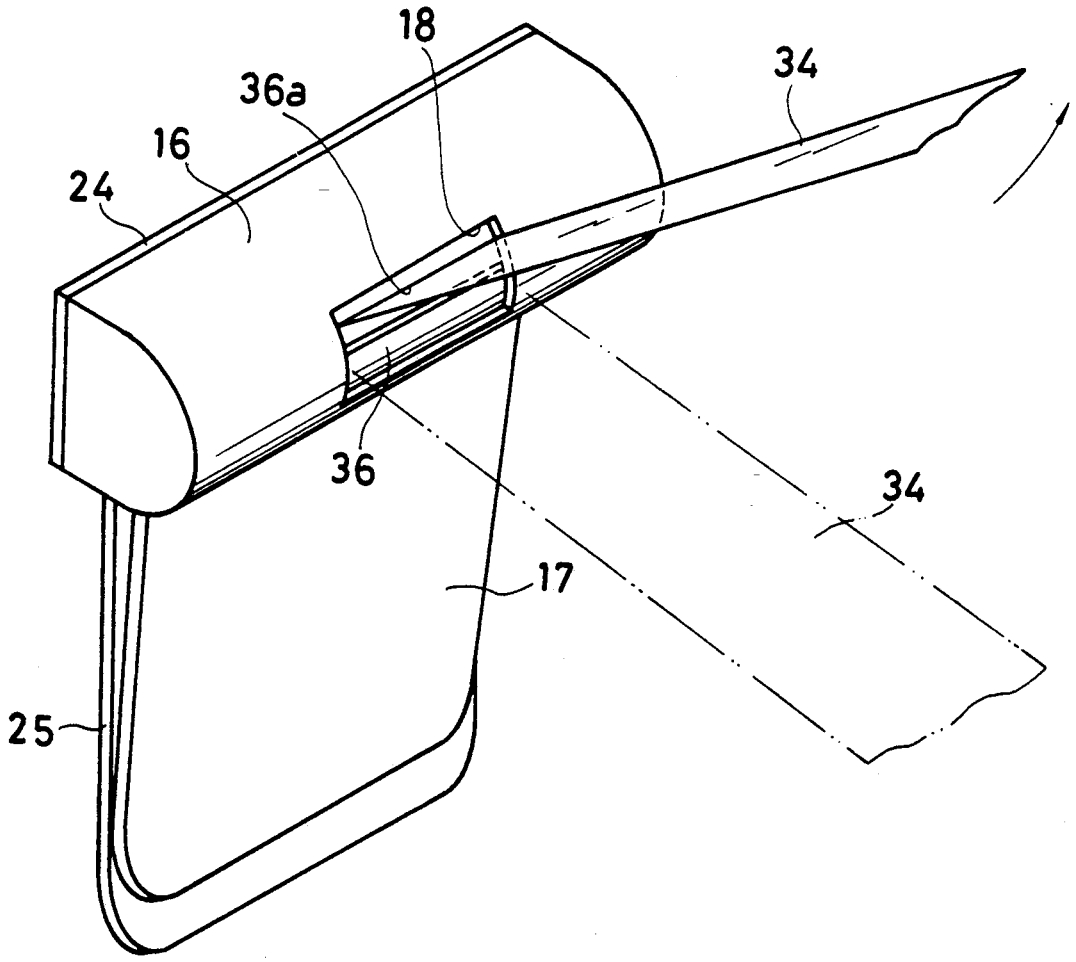
FIG. 10 is a perspective view of the embodiment when the strap is pulled upward.
Figure 11:
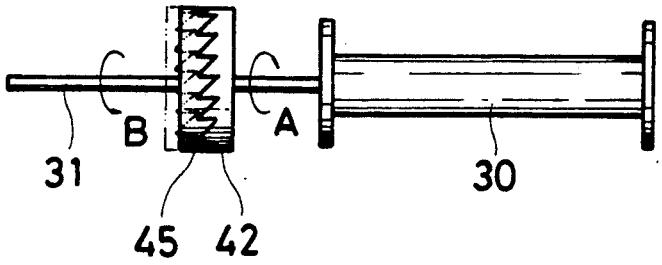
FIG. 11 is an explanatory view of the operation of the ratchet.
Figure 12:
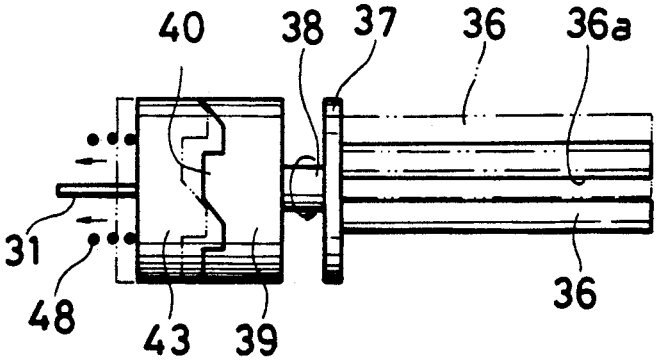
FIG. 12 is an explanatory view of the operation of the operating drum.
Figure 13:
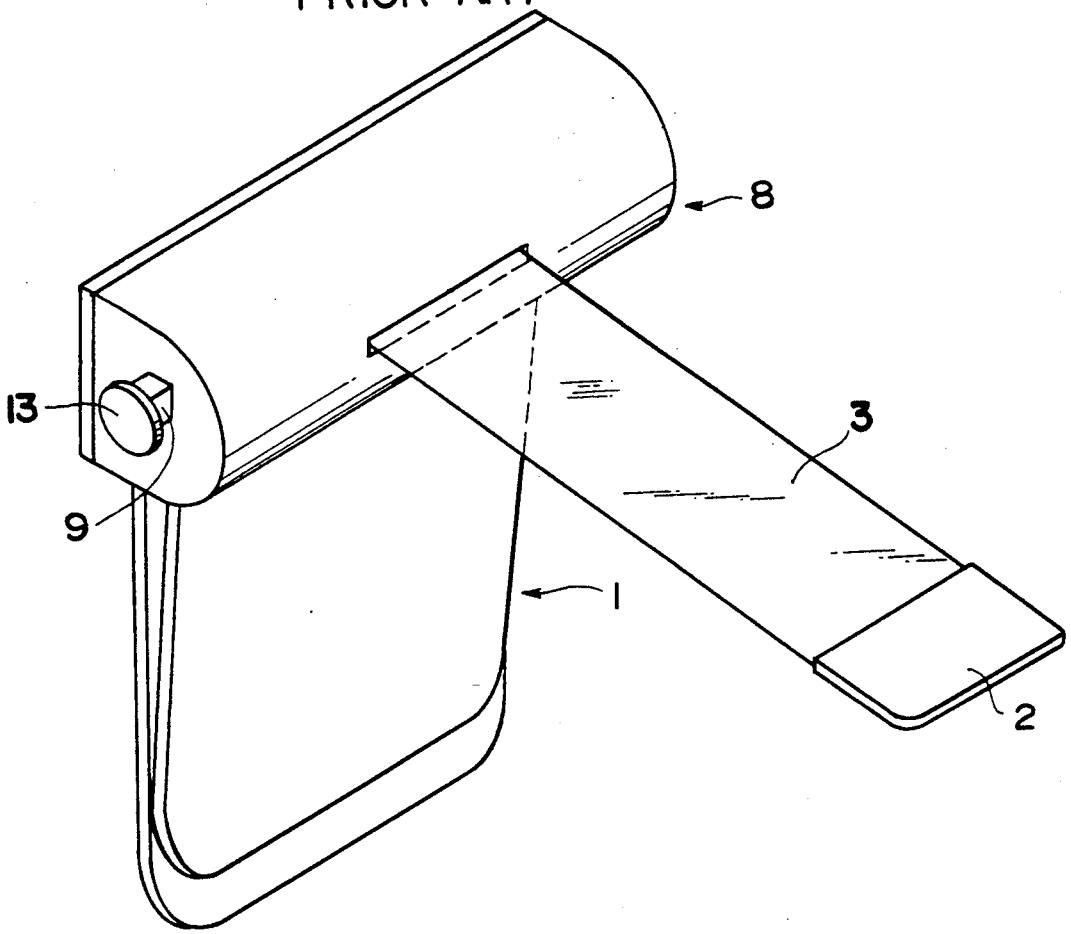
FIG. 13 PRIOR ART
FIG. 13 is a perspective view of a prior clip-carrying bookmarker devised by the inventor of the present invention.
Figure 14:
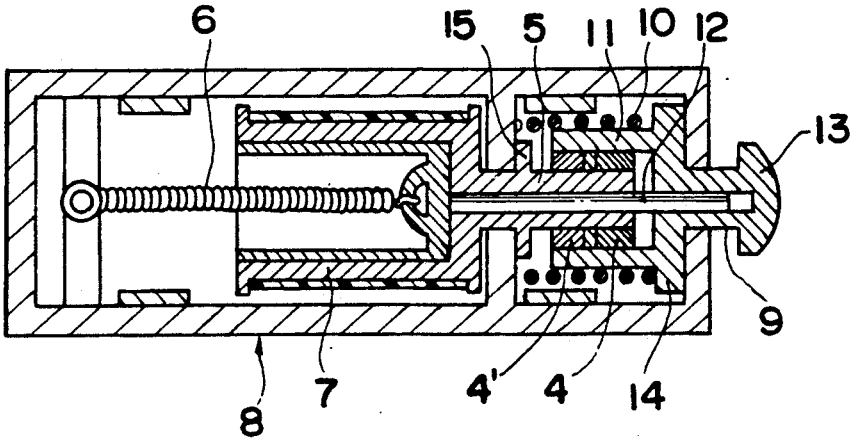
FIG. 14 PRIOR ART
FIG. 14 is a longitudinal sectional view of the clip-carrying bookmarker shown in FIG. 13 as seen from behind.
Figure 16:
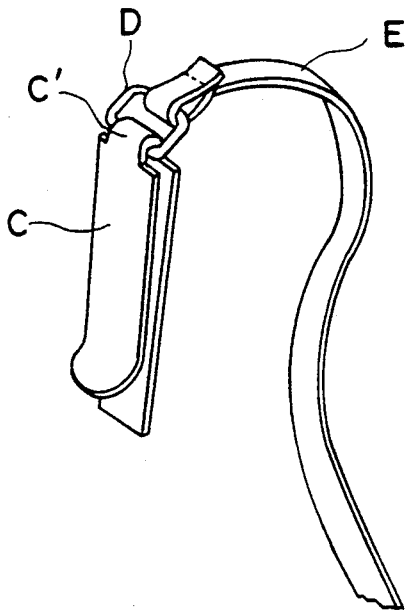
FIG. 16 PRIOR ART
FIG. 16 is a perspective view of a conventional example with a clip.
Figure 15:
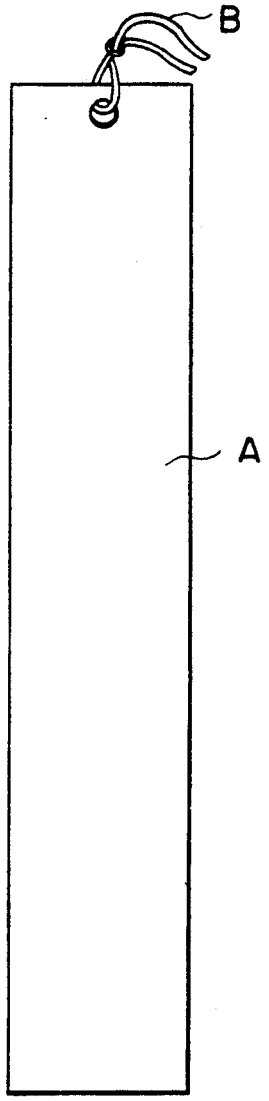
FIG. 15 PRIOR ART
FIG. 15 is a front view of a conventional example having a narrow strap with a slender paper piece.

FIG. 1 is a perspective view of an embodiment of the present invention with a strap payed out to a certain extent, FIG. 2 is a front elevation of the entire embodiment, FIG. 3 is a side elevation of the embodiment in which a strap storage box is partly cut out, FIG. 4 is a view as seen from inside of the strap storage box integrated with one piece of a clip, FIG. 5 is a view as seen from inside of a cover of the strap storage box integrated with one piece of the clip, FIG. 6 is a perspective view of a strap feed and take-up drum and a rubber string, FIG. 7 is a perspective view of one operating drum and a ratchet, FIG. 8 is a perspective view of another operating drum and a coiled spring, FIG. 9 is a longitudinal back view of the embodiment, FIG. 10 is a perspective view of the embodiment when the strap is pulled upward, FIG. 11 is an explanatory view of the operation of the ratchet, and FIG. 12 is an explanatory view of the operation of the operating drum.

Referring to the drawings, a reference numeral 16 denotes a strap storage box integrated with one piece 17 of a clip. The strap storage box 17 is provided with a strap withdrawal port 18 of a wide strap at the central portion of the front surface thereof. A rubber catch 19 is provided in the vicinity of the sidewall in one side of the strap storage box 16, and a bearing 20 of a support shaft of a strap feed and take-up drum to be described later in detail in the vicinity of the sidewall in the other side of the strap storage box 16. Further, a bearing 21 of a support shaft integral with the strap feed and take-up drum to be described later in detail is provided between the strap withdrawal port 18 and the bearing 20 in the strap storage box 16, and a guide frame 22 in which projections of the strap feed and take-up drum to be described later are slidably engaged is provided along the axial direction of the strap feed and take-up drum to be described later on the inner wall between the bearing 21 and the bearing 20.

A reference numeral 23 denotes engaging recesses formed on the inner surface of the strap storage box 16 at the back surface side thereof and to be engaged with engaging projections provided on the cover of the strap storage box.

A reference numeral 24 denotes a cover of the strap storage box 16 integral with the other piece 25 of the clip. The cover 24 is provided with engaging projections 26 to be engaged with the engaging recesses 23 of the strap storage box 16. A reference numeral 27 denotes a projection for retaining the rubber strap so as not to be removed from the rubber catch 19, a reference numeral 28 denotes a projection for retaining a support shaft integral with the strap feed and take-up drum so as not be removed from the bearing 21, and a reference numeral 29 denotes a projection for retaining the support shaft of the strap feed and take-up drum so as not to be removed from the bearing 20.

A reference numeral 30 denotes a strap feed and take-up drum. This drum 30 is opened at one end thereof, and closed at the other end thereof. It is provided with a support shaft 31 projecting outward from the closed end thereof, and the end of the support shaft 31 is rotatably supported to the bearing 20 of the strap storage box 16.

A ring-shaped catch 32 is provided in the strap feed and take-up drum 30.

A reference numeral 33 denotes a rubber string. This rubber string 33 is provided so as to extend in a twisted state between the ring-shaped catch 32 and the rubber catch 19 of the strap storage box 16. The rubber string 33 is provided for the purpose of urging the strap feed and take-up drum 30 constantly in the direction in which the strap is taken up.

A reference numeral 34 denotes a strap made by cutting a transparent plastic film to the shape of a belt. The strap 34 is fastened at its one end portion to the strap feed and take-up drum 30, and wound in its entirety around the same drum 30. The other end of the strap 34 projects outward through the strap withdrawal port 18 of the strap storage box 16, and provided with a tag 35 at its free end portion.

A reference numeral 36 denotes a rotating plate. The rotating plate 36 extends along the shaft of the strap feed and take-up drum 30 on the outer periphery of the strap feed and take-up drum 30, and an axial cutout **36*a* of a predetermined width is provided at the center of the rotating plate 36. The strap is inserted into the cutout 36*a* of the rotating plate 36**.

A reference numeral 37 denotes a disc for holding the rotating plate 36. A reference numeral 38 denotes a support shaft for the disc 37. The support shaft 38 is rotatably supported to the bearing 21 of the strap storage box 16. A reference numeral 39 denotes one operating drum provided integrally with the support shaft 38. The operating drum 39 has a plurality of sawtooth-shaped projections 40 on the end surface thereof. Coaxial through holes 41 are respectively formed at the centers of the disc 37, the support shaft 38 and the operating drum 39, and the support shaft 31 of the strap feed and take-up drum 30 is rotatably inserted into the through holes 41 of the disc 37, the support shaft 38 and the operating drum 39.

A reference numeral 42 denotes a ratchet, which is arranged inside the one operating drum 39 and fixed to the support shaft 31 of the strap feed and take-up drum 30. The outer peripheral surface of the ratchet 42 is slidably contacted with the inner peripheral surface of the operating drum 39.

A reference numeral 43 denotes another operating drum as the other one of a pair together with the one operating drum 39. The operating drum 43 has a plurality of sawtooth-shaped projections 44, which are meshed with the projections 40 of the operating drum 39, on the opposed surfaces thereof. A ratchet 45 meshed with the ratchet 42 is integrally provided inside the operating drum 43. A projection 46 to be slidably inserted into the guide frame 22 of the strap storage box 16 is provided on the outer periphery of the operating drum 43, and the support shaft 31 of the strap feed and take-up drum 30 is rotatably inserted into a through hole 47 formed at the center thereof.

A reference numeral 48 denotes a coiled spring. This spring 48 is provided between the operating drum 43 of the side to be horizontally moved and the inner surface of the sidewall of the strap storage box 16 so that the spring 48 constantly urges the drum 43 toward the operating drum 39.

As shown in FIG. 10, when the end of the strap 34 is raised upward in a pulling state, the entirety of the rotating plate 36, the support shaft 38 and the operating drum 39 are rotated as indicated by an arrow in FIG. 12. Thus, the operating drum 43 is horizontally moved to a position indicated by an imaginary line in FIG. 12. When the drum 43 is horizontally moved, the projection 46 is slid in the guide frame 33. Therefore, the drum 43 is not rotated.

In this manner, the engagement of the ratchet 42 with the ratchet 46 is released, and the strap feed and take-up drum 30 is rotated so as to take up the strap 34.

When the strap 34 is pulled out, i.e., when the support shaft 31 is rotated in a direction indicated by an arrow A in FIG. 11, the ratchet 45 is horizontally pushed back with respect to the ratchet 42. When the strap 34 is stopped to be pulled out, i.e., when the support shaft 31 is rotated in a reverse direction indicated by an arrow B in FIG. 11, the teeth of the ratchets 42 and 45 are meshed with each other to stop rotating.

The present invention having the above-described construction and operation enables the strap to be rewound by raising the end of the strap upward while pulling the end of the strap at the same time. Therefore, the operating shaft projecting from the strap storage box required for a conventional clip-carrying bookmarker can be eliminated. Further, the disadvantages of the conventional clip-carrying bookmarker such as a rewind of the strap irrespective of a user's intention, a clip removed from a book due to an engagement of the operating shaft with other article can be eliminated.

Further, the clip-carrying bookmarker of the present invention provides a simple and satisfactory external appearance in its design. Moreover, the strap can be rewound smoothly to the last portion.

The present invention is not, of course, limited to the above embodiment; it may be modified in various ways within the scope of the appended claim.

What is claimed is:

1. A clip-carrying bookmarker comprising:

a strap storage box (16) formed integrally with one piece (17) of a clip, said strap storage box including: a wide strap withdrawal port (18) at a central portion of a front side thereof, a rubber catch (19) in the vicinity of one sidewall therein, a first bearing (20) of a first support shaft (31) in the vicinity of a second sidewall thereof, a second bearing (21) of a second support shaft (38) integral with a first operating drum (39) between said strap withdrawal port (18) and said first bearing (20), and a guide frame (22) in which a plurality of projections (46) of a second operating drum (43) are slidably engaged with an inner wall portion thereof between said second bearing (21) and said first bearing (20);

a cover (24) formed integrally with another piece (25) of said clip and covering an open side of said strap storage box (16);

a strap feed and take-up drum opened at one end thereof and closed a second end thereof, said drum having said first support shaft (31) externally projecting from said closed end thereof in such a manner that an end portion of said first support shaft (31) is rotatably supported by said first bearing (20) of said strap storage box (16);

a rubber string (33) provided in a twisted state and set at one end on a rubber string fastening catch (32) formed at a central portion of an inner surface of the closed end of said strap fed and take-up drum (30) and at a second end on said rubber catch (19) affixed within the interior of said strap storage box (16);

a strap (34) connected at one end thereof to said strap feed and take-up drum (30) to be entirely wound on said strap feed and take-up and drawn at a second end thereof from said strap withdrawal port (18) of said strap storage box 16 through an axial cutout (36*a*) of a rotating plate (36);

said rotating plate (36) extending along the outer periphery of said strap feed and take-up drum (30);

a disc (37) attached to one end of said second support shaft and having an axial through hole in which the first support shaft (31) of said strap feed and take-up drum (30) is rotatably received and having said rotating plate (36) affixed thereto, said second support shaft (38) being provided with an axial through hole in which the first support shaft (31) of said strap feed and take-up drum (30) is rotatably received;

said first operating drum (39) having a plurality of sawtooth-shaped projections (40) on one end surface thereof and being formed with an axial through hole in which the first support shaft 31 of said strap feed and take-up drum (30) is rotatably received;

a first circular disc ratchet (42) arranged inside said first operating drum (39) and fixed to the support shaft (31) of said strap feed and take-up drum (30);

said second operating drum (43) having a plurality of sawtooth-shaped projections (44) to be meshed with the sawtooth-shaped projections (40) of said first operating drum (39) at one end surface thereof, said second operating drum being integrally provided with a second annular ratchet (45) to be meshed with said first ratchet (42) inside thereof, said second operating drum being provided with said projections (46) on an outer periphery thereof, and being provided with an axial through hole (47) in which the first support shaft (31) of said strap feed and take-up drum (30) is rotatably received; and a coiled spring (48) arranged between said second operating drum (43) and the inner surface of the second sidewall of said strap storage box (16) for urging said second operating drum (43) constantly toward the first operating drum (39).

* * * * *